US009291431B2

(12) United States Patent
Ohlson

(10) Patent No.: US 9,291,431 B2
(45) Date of Patent: Mar. 22, 2016

(54) BLAST-PROOF CHAMBER FOR HANDLING OF EXPLOSIVE OBJECTS

(75) Inventor: Johnny Ohlson, Kil (SE)

(73) Assignee: Dynasafe International AB, Stockholm (SE)

( * ) Notice: Subject to any disclaimer, the term of this patent is extended or adjusted under 35 U.S.C. 154(b) by 6 days.

(21) Appl. No.: 14/344,209

(22) PCT Filed: Sep. 13, 2012

(86) PCT No.: PCT/SE2012/000137

§ 371 (c)(1),
(2), (4) Date: May 21, 2014

(87) PCT Pub. No.: WO2013/039439

PCT Pub. Date: Mar. 21, 2013

(65) Prior Publication Data

US 2014/0338518 A1 Nov. 20, 2014

(30) Foreign Application Priority Data

Sep. 16, 2011 (SE) ..... 1100679

(51) Int. Cl.

| | |
|---|---|
| ***F42D 5/04*** | (2006.01) |
| ***F41H 5/00*** | (2006.01) |
| ***F42D 5/045*** | (2006.01) |
| ***F42B 39/14*** | (2006.01) |
| *F42B 33/06* | (2006.01) |
| *F42B 39/22* | (2006.01) |

(52) U.S. Cl.

CPC *F41H 5/00* (2013.01); *F42B 39/14* (2013.01); *F42D 5/045* (2013.01); *F42B 33/06* (2013.01); *F42B 39/22* (2013.01); *F42D 5/04* (2013.01)

(58) Field of Classification Search

CPC ..... F42D 5/04; F42D 5/045
USPC ..... 86/50; 102/402, 403; 89/1.3
See application file for complete search history.

(56) References Cited

U.S. PATENT DOCUMENTS

| | | | | |
|---|---|---|---|---|
| 5,884,569 | A | 3/1999 | Donovan | |
| 6,354,181 | B1 * | 3/2002 | Donovan | F42D 5/045 110/237 |
| 2003/0209133 | A1 * | 11/2003 | Greenfield | F42D 5/04 86/50 |
| 2012/0017750 | A1 * | 1/2012 | Koide | F42B 33/06 86/50 |

FOREIGN PATENT DOCUMENTS

| | | | | |
|---|---|---|---|---|
| CA | WO 2005015119 | A1 * | 2/2005 | B65D 88/04 |
| CN | 1255964 | A | 6/2000 | |
| CN | 1340148 | A | 3/2002 | |
| EP | 0315616 | A1 | 5/1989 | |
| FR | 2440937 | A * | 2/2008 | E05G 5/02 |

(Continued)

*Primary Examiner* — Samir Abdosh
*Assistant Examiner* — John D Cooper
(74) *Attorney, Agent, or Firm* — Novak Druce Connolly Bove + Quigg LLP

(57) ABSTRACT

The invention relates to a blast-proof chamber (1, 20, 30, 60, 70) for improved handling and transport of a detonation-dangerous object, wherein the said blast-proof chamber (1, 20, 30, 60, 70) comprises an outer chamber (2, 21, 32, 61, 71) comprising an inner storage chamber (3, 22, 33, 62, 72) for storage of the detonation-dangerous object. A characteristic feature of the invention is that the inner storage chamber (3, 22, 33, 62, 72) is arranged movably in the outer chamber (2, 21, 32, 61, 71) between an open and a closed position.

15 Claims, 14 Drawing Sheets

(56) References Cited

FOREIGN PATENT DOCUMENTS

| | | | | | |
|---|---|---|---|---|---|
| GB | 2387526 | A | | 10/2003 | |
| GB | 2440937 | A | | 2/2008 | |
| GB | 2440937 | A | * | 2/2008 | ..... E06B 3/90 |
| SE | 0315616 | A1 | * | 5/1989 | ..... F42D 5/045 |
| WO | WO-2005/015119 | A1 | | 2/2005 | |
| WO | WO 2005015119 | A1 | * | 2/2005 | ..... F42B 39/24 |
| WO | WO-2011/021969 | A1 | | 2/2011 | |

* cited by examiner

BLAST-PROOF CHAMBER FOR HANDLING OF EXPLOSIVE OBJECTS

CROSS REFERENCE TO RELATED APPLICATIONS

This application is a National Phase filing under 35 U.S.C. §371 of PCT/SE2012/00137 filed on Sep. 13, 2012; and this application claims priority to Application No. 1100679-8 filed in Sweden on Sep. 16, 2011 under 35 U.S.C. §119; the entire contents of all are hereby incorporated by reference.

The invention relates to a blast-proof chamber for handling and transport of detonation-dangerous objects.

The invention especially relates to a chamber for handling and transport of detonation-dangerous objects of the improvised explosive device type, so-called IEDs, which are used in vehicles, for example, with the aim of creating greatest possible devastation in urban areas. The invention also relates to the handling of explosive devices detected at airports, and to the handling and transport of explodable goods, for example ammunition and explosives.

PROBLEM DEFINITION AND BACKGROUND TO THE INVENTION

IEDs pose a growing threat in present-day society and large resources are invested in the detection and handling of explosive devices at airports, at port terminals and at border controls.

Detection of an explosive device in freight or in hand baggage at an airport normally involves extensive evacuation and cordoning-off of the region around the explosive device, as well as complicated actions involving remote-controlled manipulators and blast-proof containers. Where necessary, access to gas-tight blast containers for handling of objects suspected of containing or generating toxic gas is also required. Correspondingly, the detection of a vehicle prepared with an explosive device involves extensive evacuation and cordoning-off.

Defusing of an explosive device applied in a vehicle is normally impossible or very difficult to perform without triggering the explosive device. The doors and wheels of the vehicle can be provided with devices which activate the priming mechanism of the explosive device when the vehicle starts rolling or when a door is opened.

Blast-proof chambers for the handling and transport of detonation-dangerous objects detected in the baggage control at airports are known from the literature.

Figure 2:
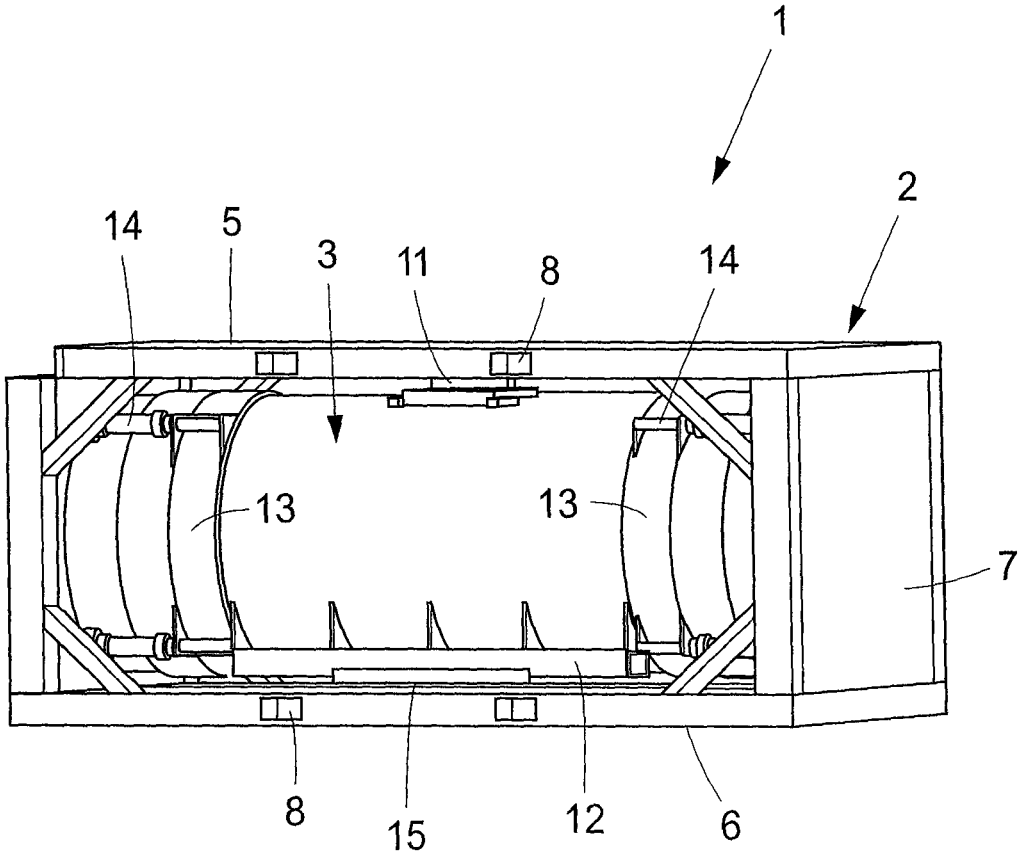

Document GB 2440937 A, 20 Feb. 2008, FIG. 2, describes a mobile blast-proof chamber for use in connection with the baggage control at an airport. On one side of the outer shell 1 of the blast chamber, which shell has the form of an upright cylinder, is arranged an opening 5 into the blast chamber for incoming baggage, and on the other side is arranged an opening 6 out from the blast chamber for outgoing baggage. The blast chamber comprises two mutually facing, curved rotatable doors 2, which are coupled together by two criss-crossed struts and are connected to a rotation device 4. The length of the doors 2 is such that the distances between the doors 2 correspond to the length of the openings 5, 6 in the outer shell 1 of the blast chamber.

When a detonation-dangerous object is detected, the rotation device 4 is activated, which rotates the doors by a quarter turn in the horizontal plane of the blast chamber, whereupon the doors 2 block the two openings 5, 6 in the outer shell 1 and the blast chamber is closed. After the blast chamber has been closed, the blast chamber containing the detonation-dangerous object is transferred to a safe place.

The configuration of the blast chamber as an upright cylinder makes the blast chamber wide and unwieldy in the handling of a larger detonation-dangerous object, for example, in the handling of a vehicle prepared with an explosive device. A wide chamber means limited passability in the case of, for example, transports on small urban roads or of transfers between different rooms in a building.

The configuration of the blast chamber with two inner curved doors and an outer shell also implies, inter alia, the following drawbacks:

- the doors, as well as the outer shell, must be dimensioned for a maximum blast pressure of the explosive device, which makes the blast chamber unnecessarily heavy,
- overlapping between the inner doors and the outer shell entails play, which makes sealing of the chamber more difficult,
- limited possibilities in respect of the loading and unloading of a detonation-dangerous object to and from the chamber.

AIM OF THE INVENTION AND ITS DISTINGUISHING FEATURES

A principal object of the present invention is a flexible blast-proof chamber for handling of detonation-dangerous objects, in which the chamber is configured for high passability in the case of transports on minor roads or of transfers between different rooms in a building.

A second object of the invention is a blast-proof chamber with improved closing function, in which play has been eliminated or heavily reduced.

A third object of the invention is a blast-proof chamber with simplified handling of a detonation-dangerous object during loading and unloading.

The said objects, and other aims not enumerated here, are satisfactorily met within the scope of that which has been defined in the present independent patent claims. Embodiments of the invention are defined in the dependent patent claims.

Thus, according to the present invention, an improved blast-proof chamber for handling and transport of detonation-dangerous objects has been provided, comprising an outer chamber in which an inner storage chamber is arranged for storage of the detonation-dangerous object.

A characteristic feature of the blast-proof chamber is that the inner storage chamber is arranged movably in the outer chamber between an open and a closed position.

According to further aspects of the blast proof chamber according to the invention:

the inner chamber is arranged detachably in the outer chamber, the outer chamber is box-shaped or container-shaped with square or rectangular cross section comprising two long sides, a base, a roof and two end faces, whereof the two long sides are open for loading and unloading of the detonation-dangerous object to and from the inner chamber, and the inner chamber is tubular with circular cross section comprising a casing part and two end face parts, wherein the two end face parts are open for loading and unloading of the detonation-dangerous object, the inner storage chamber is arranged rotatably in the outer chamber between an open and a closed position, via a rotation mechanism disposed in the outer chamber, the inner storage chamber is rotatable in the vertical plane of the outer chamber, the blast-proof chamber comprises two separate closing end faces disposed in the outer chamber for closing and sealing of the inner chamber, the closing end faces are arranged movably in the axial direction in the outer chamber via hydraulic pistons disposed on the inner side of the outer chamber, the two closing end faces comprise an expandable sealing strip for locking and sealing of the inner chamber, the rotation mechanism is manual and is operated with a detachable handle disposed on the top side of the outer chamber, wherein the handle is rotatable by a quarter turn, clockwise or anti-clockwise, in the horizontal plane between an open and a locked position, in which the open position automatically releases the inner chamber from the outer chamber via a pretensioned locking mechanism, the release mechanism comprises a spring bolt and a pretensioning mechanism, wherein the spring bolt in the pretensioned state locks the inner chamber and in the non-pretensioned state releases the inner chamber, the spring bolt is pretensioned via an electromagnetically controlled spring mechanism, the outer chamber also comprises a rotatable support plate on which the inner chamber rests.

ADVANTAGES AND EFFECTS OF THE INVENTION

The present invention now offers an improved blast-proof chamber for handling and transport of detonation-dangerous objects, for example handling and transport of a suspect vehicle in a town or handling of a suspect baggage item at an airport.

The movably arranged inner chamber enables simplified handling during loading and unloading to and from the chamber.

The outer configuration of the chamber enables improved passability in the case of transport on small urban roads or of transfer between different rooms in a terminal building at an airport.

Separate closing end faces eliminate or heavily reduce the play in opening and closing of the chamber, which also enables effective gas sealing of the chamber.

The detachable inner chamber enables flexible emptying of the chamber without the detonation-dangerous object needing to be handled directly, for example when storing the object in an explosives store, wherein the inner chamber can be utilized as storage packaging.

The especially novel aspect of the chamber is therefore its configuration with a movable and detachable inner chamber, as well as closing and sealing with two separate closing and sealing end faces.

From the above-stated, it will probably be evident that all activities associated with the handling of a detonation-dangerous object can be safely carried out without difficulty via the blast chamber according to the invention.

The blast chamber according to the invention thus meets all the requirements which might be placed on a blast chamber of the here intended type.

Further advantages and effects will emerge from a study and consideration of the following detailed description of the invention, including one of its advantageous embodiments, the patent claims and the accompanying drawing figures.

LIST OF FIGURES

Figure 1:
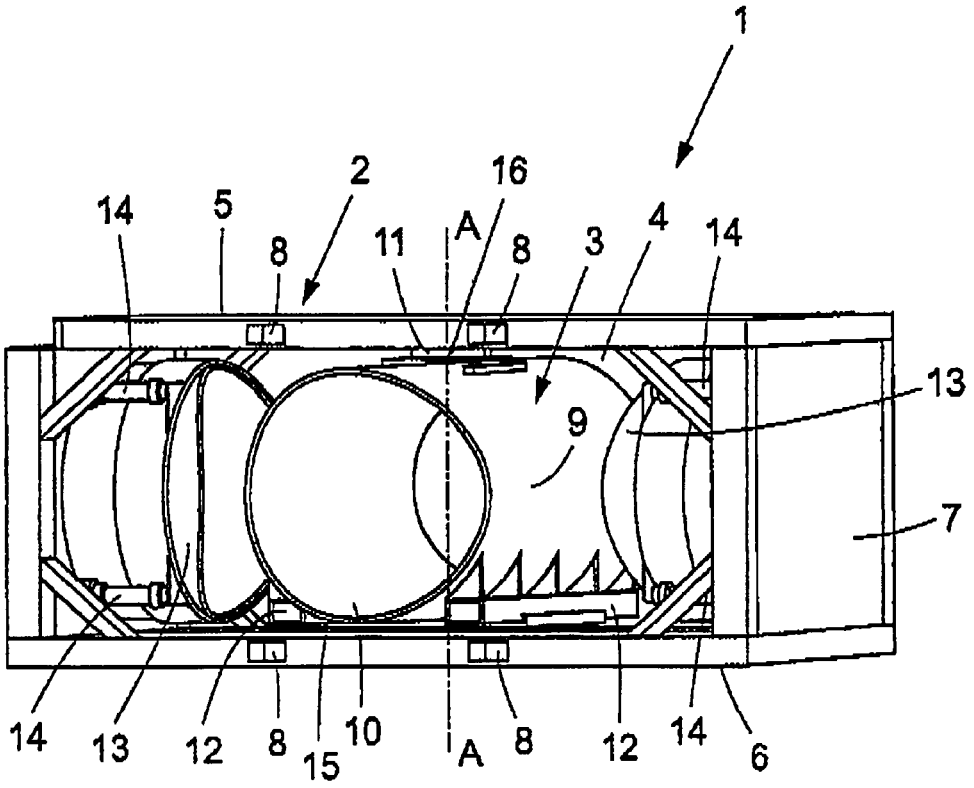
Figure 3:
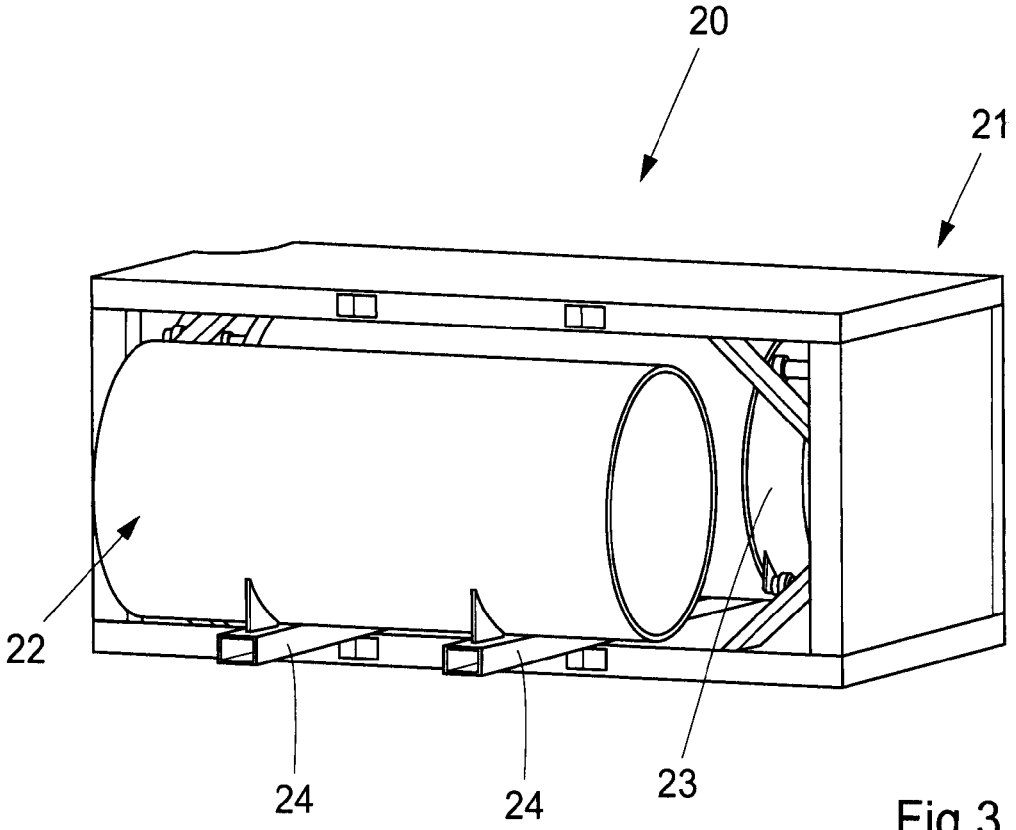
Figure 4:
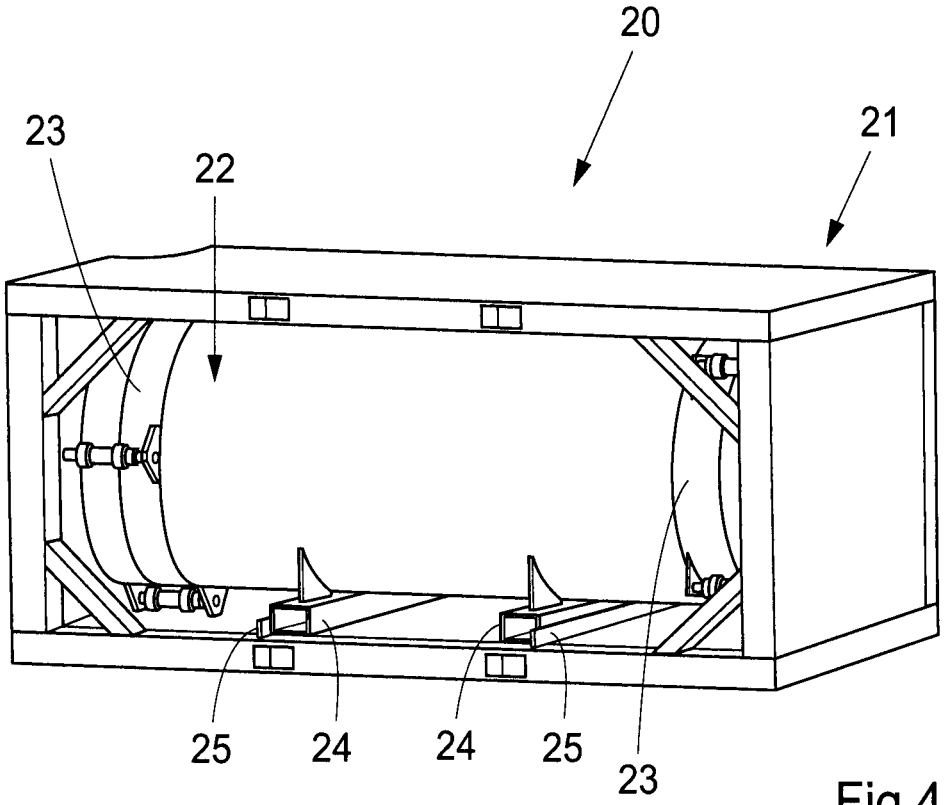
Figure 5:
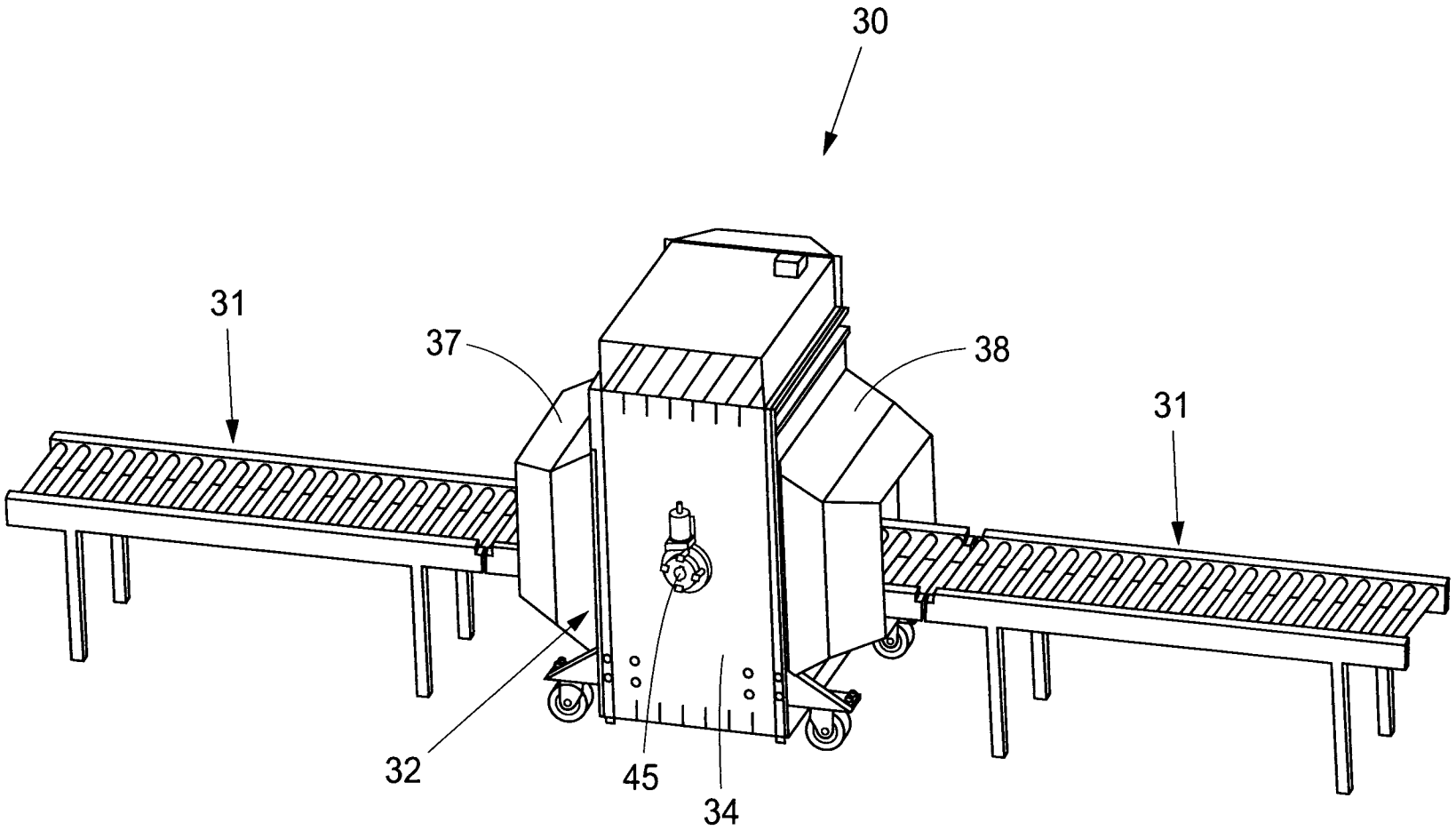
Figure 6:
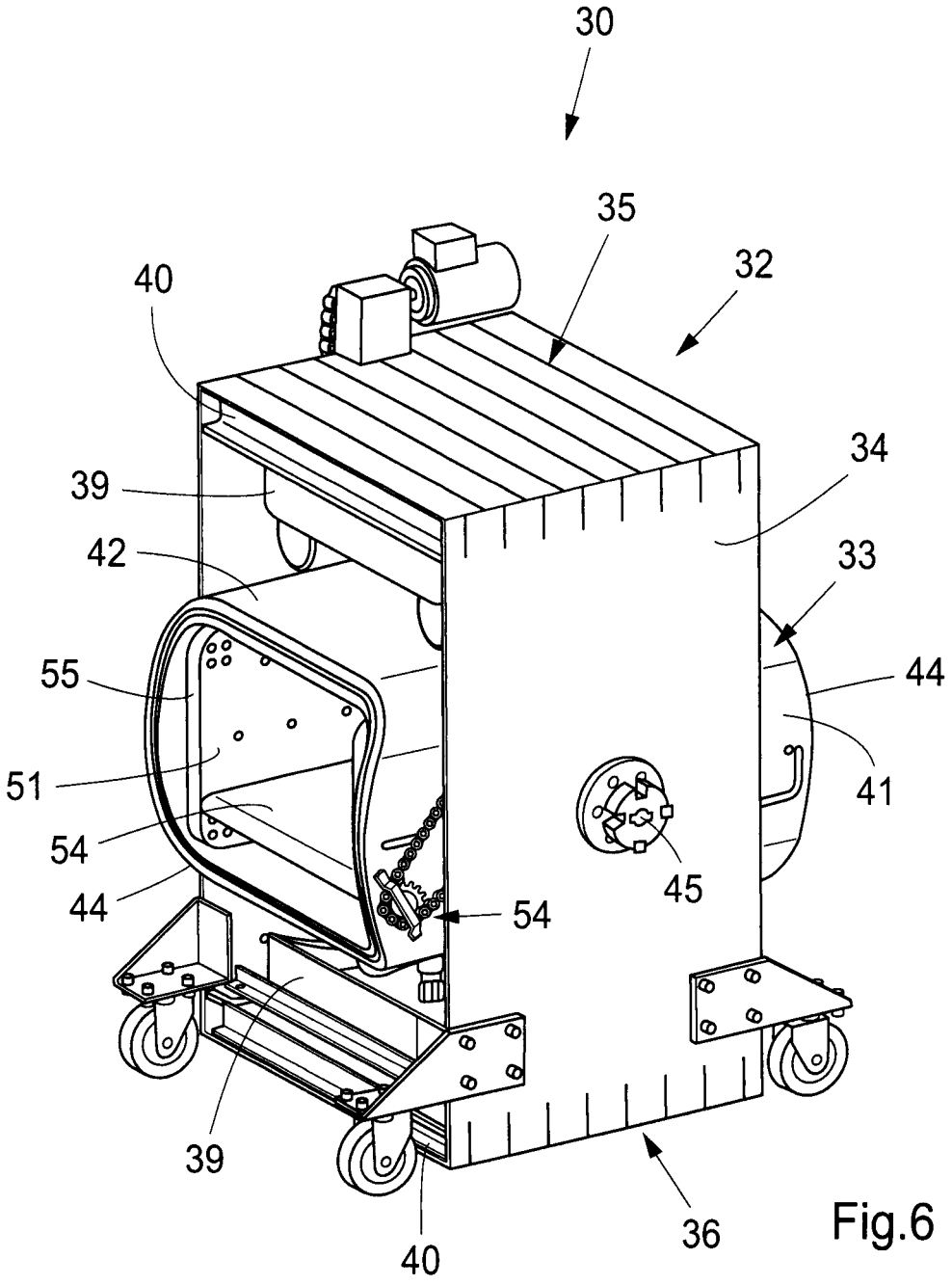
Figure 7:
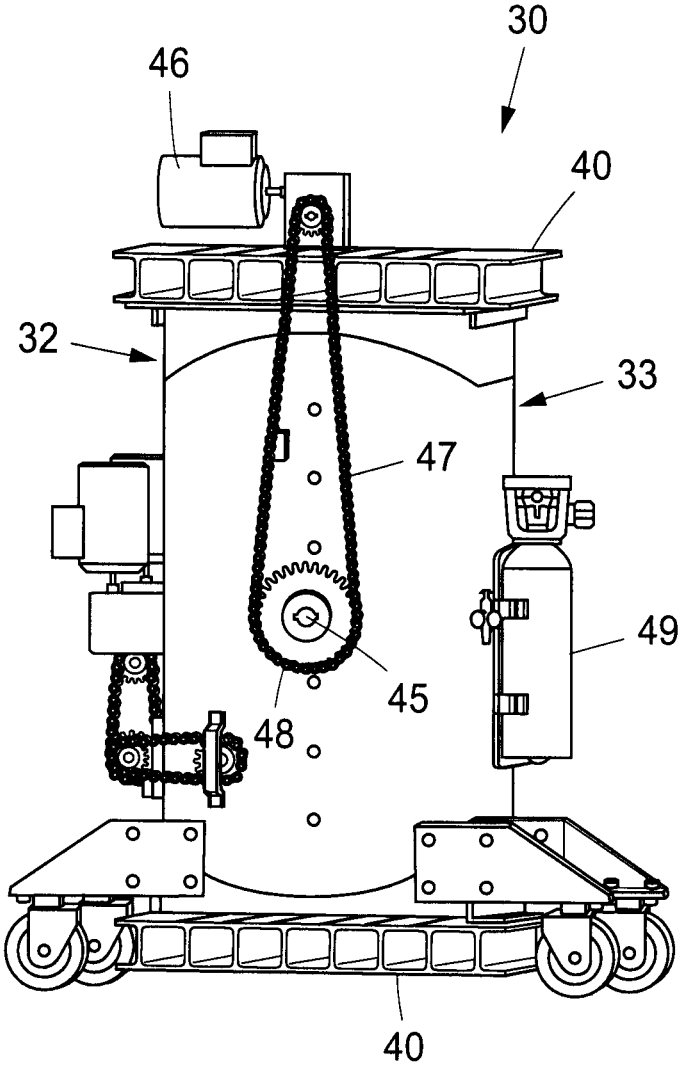
Figure 8:
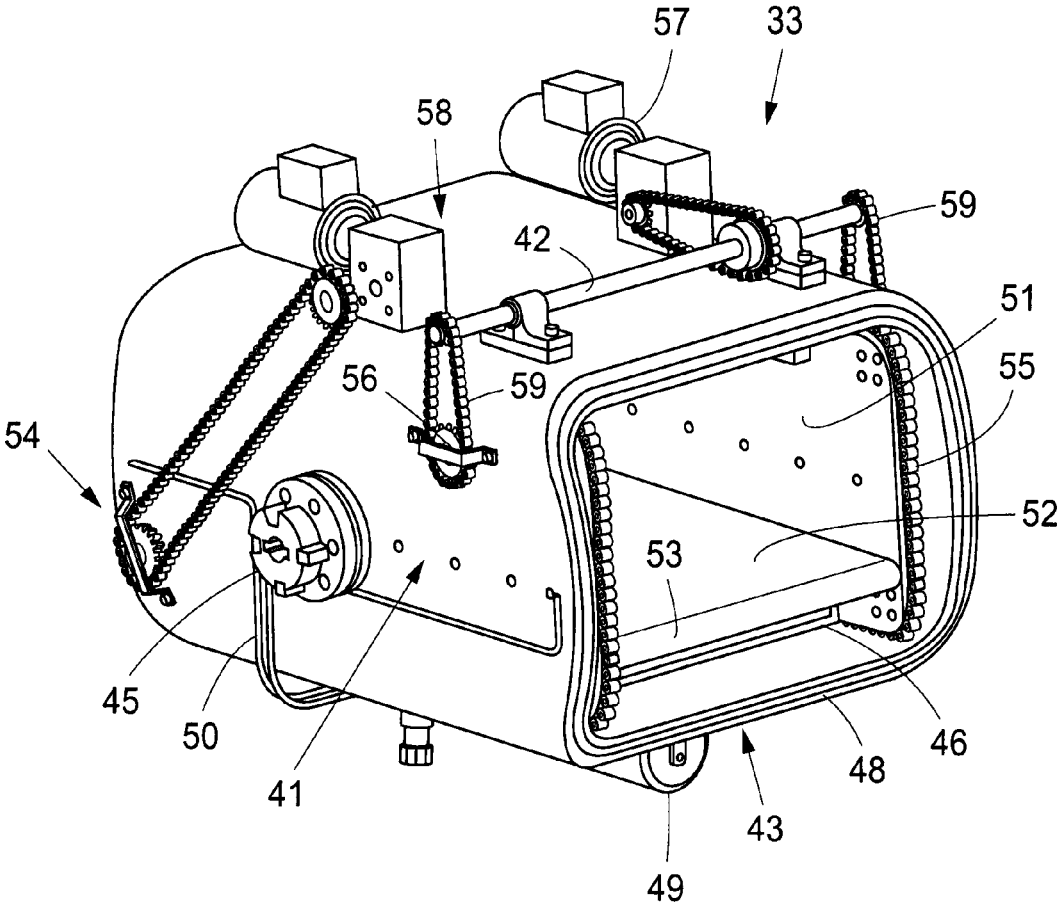
Figure 9:
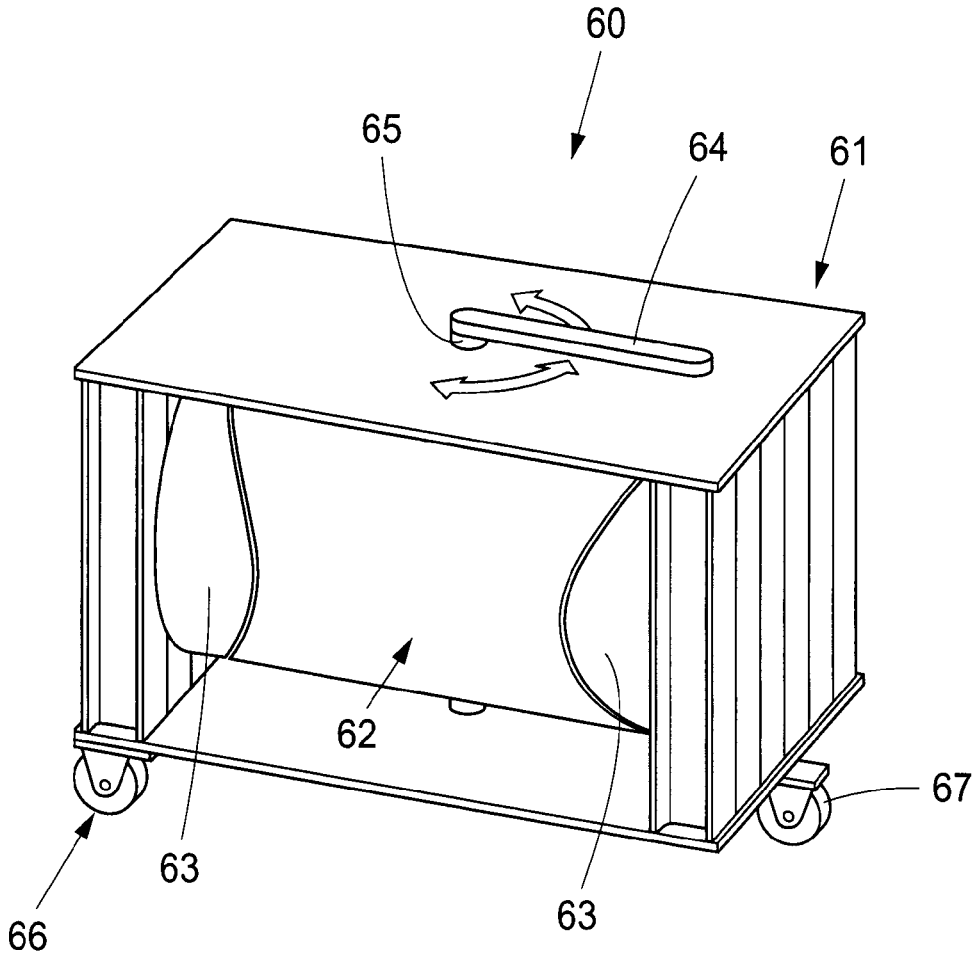
Figure 10:
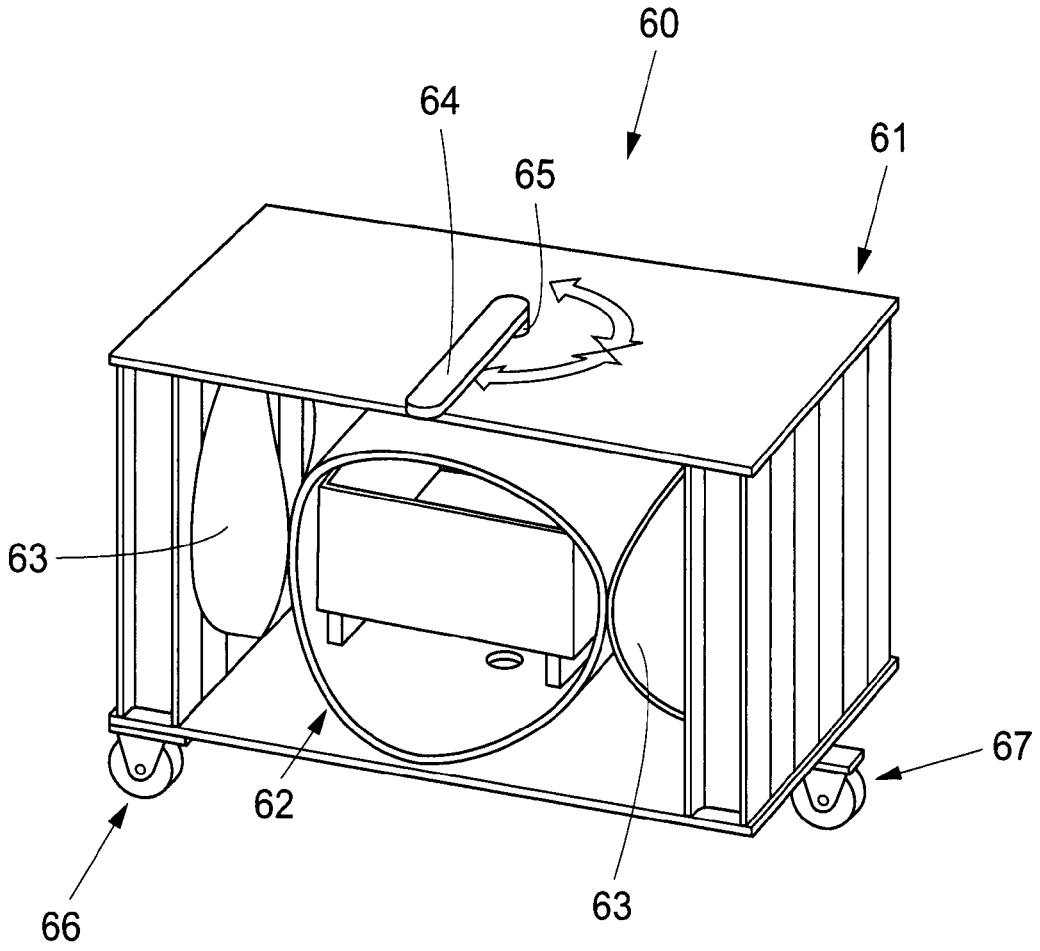
Figure 11:
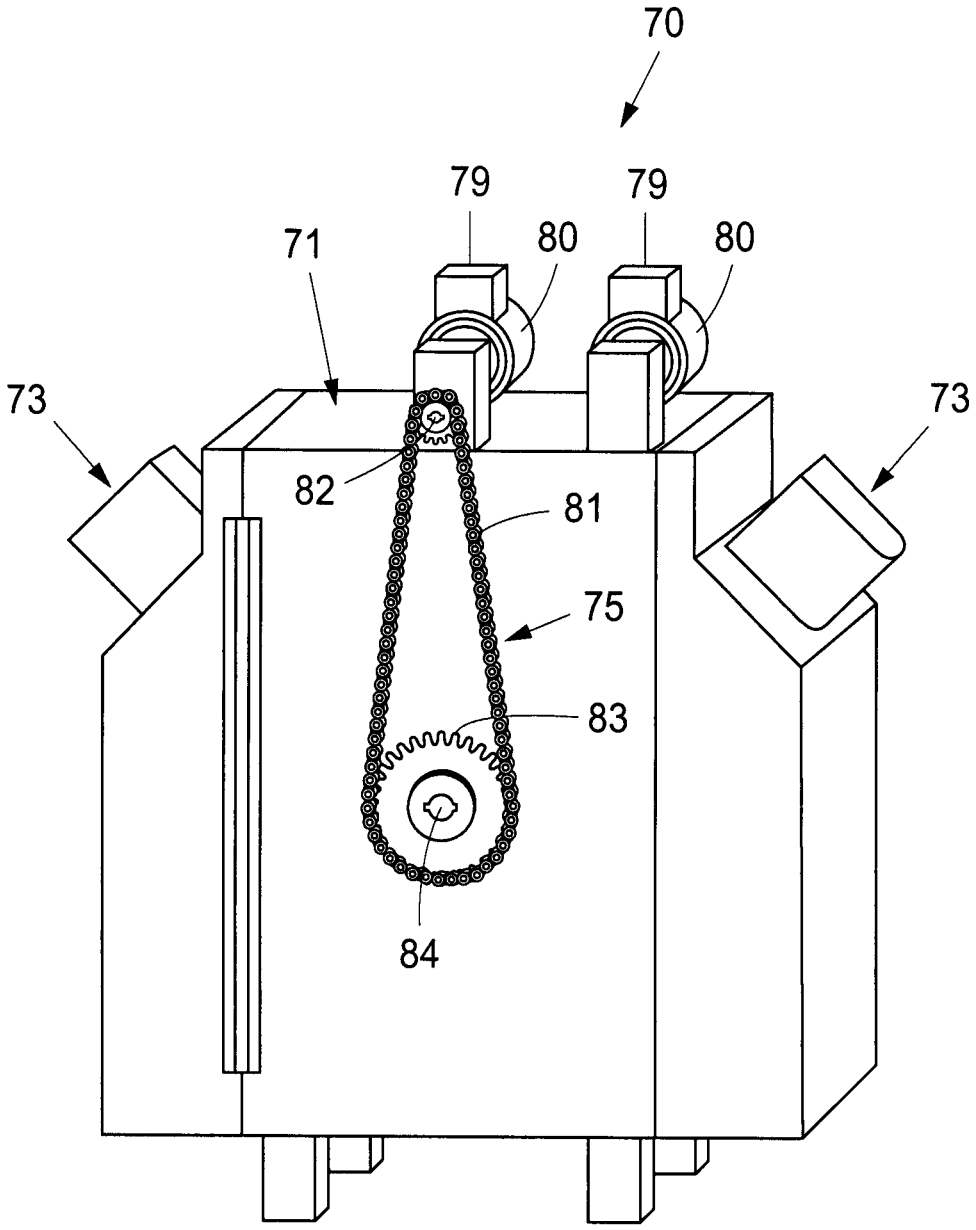
Figure 12:
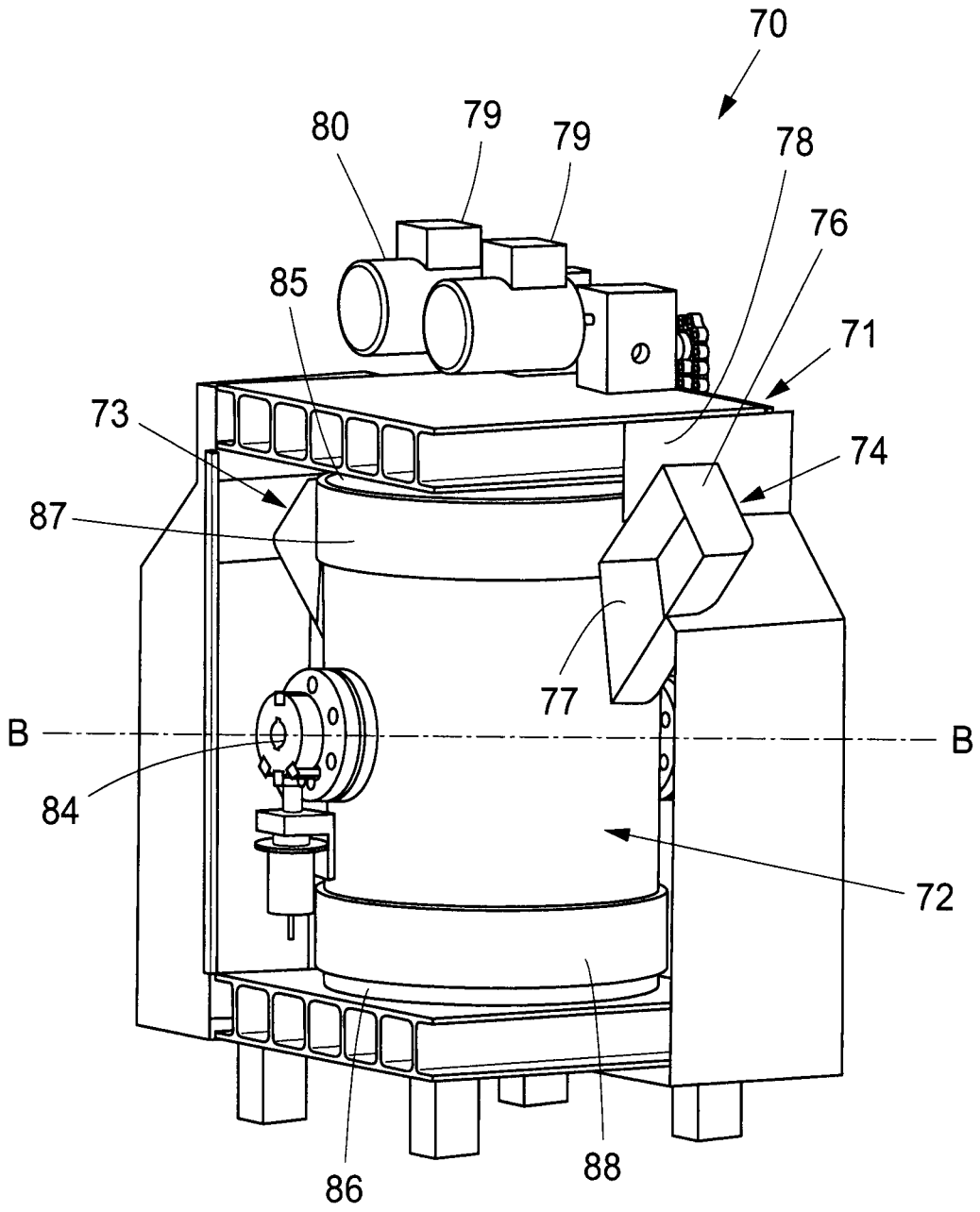
Figure 13:
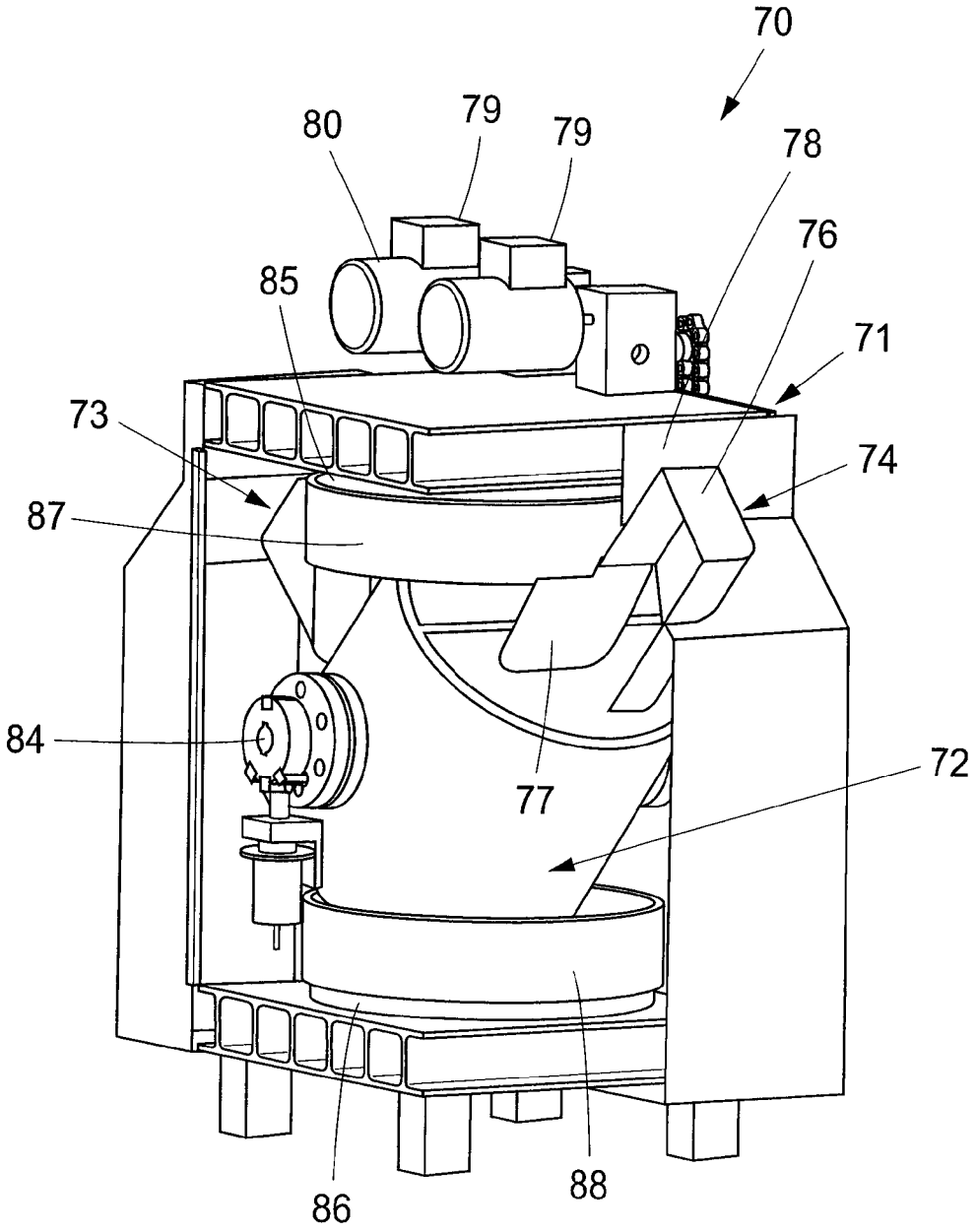
Figure 14:
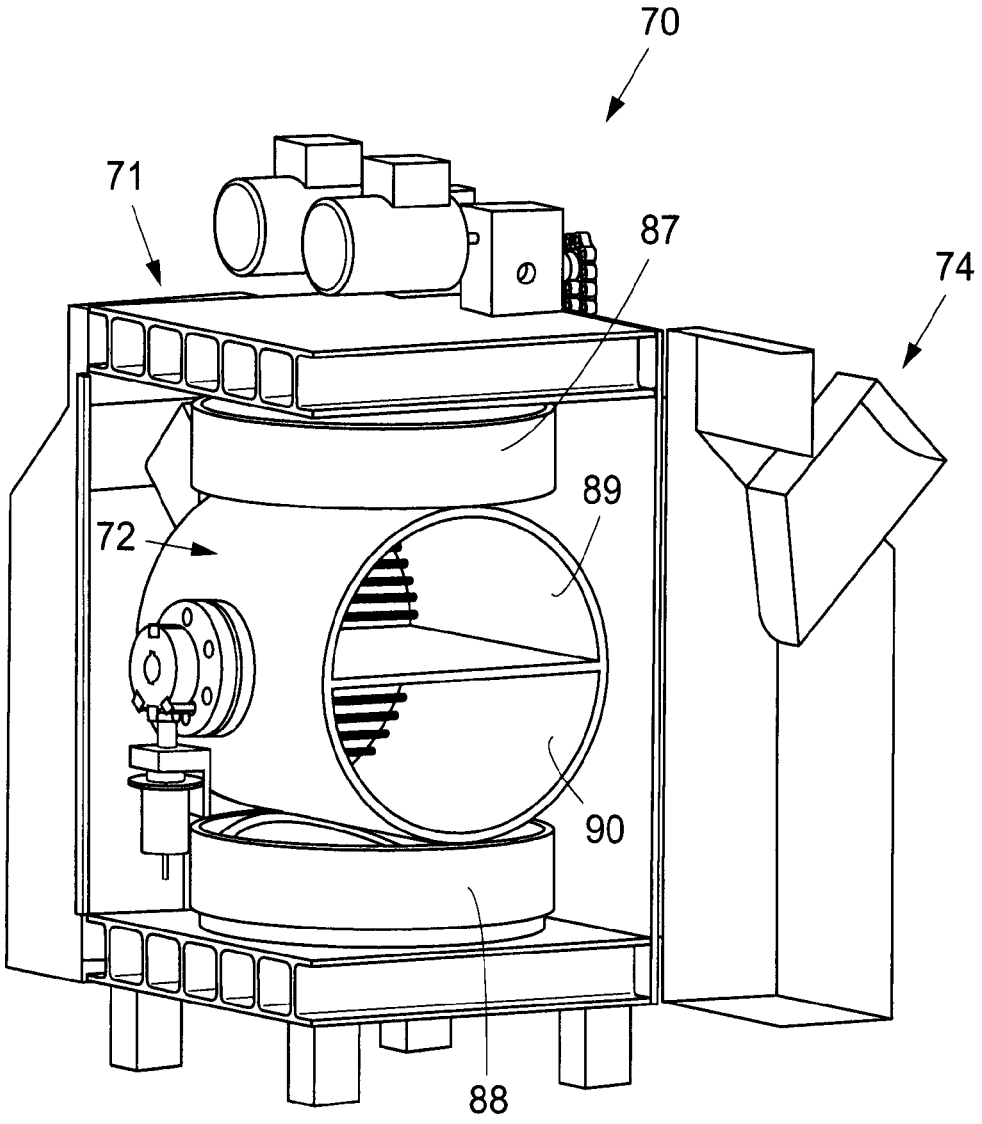

The invention has been defined in the following patent claims and will now be described somewhat further in connection with the appended figures, in which:

FIG. 1 shows schematically a view obliquely from above of a first embodiment of a blast-proof chamber according to the invention, for handling of large detonation-dangerous objects, comprising an outer chamber and an inner rotatable chamber, FIG. 2 shows the chamber according to FIG. 1, in which the inner chamber is in the closed position, FIG. 3 shows a special embodiment of a chamber according to FIG. 1, comprising an inner chamber which can be pulled out in the lateral direction, FIG. 4 shows the chamber according to FIG. 3, in which the inner chamber is in a closed position, FIG. 5 shows schematically a view obliquely from above of a second embodiment of a blast-proof chamber according to the invention, intended for handling of small and medium-sized detonation-dangerous objects in baggage controls at an airport, wherein the chamber comprises an inner rotatable storage chamber, FIG. 6 shows the chamber according to FIG. 5, in which the inner storage chamber has been rotated into the open horizontal position, FIG. 7 shows a detailed view of the chamber according to FIG. 5, in which the rotation mechanism of the inner chamber can be seen, FIG. 8 shows a detailed view of the inner chamber according to FIG. 6, in which the drive mechanism for the closing blind of the chamber can be seen, FIG. 9 shows schematically a view obliquely from above of a third embodiment of a blast-proof chamber according to the invention, for handling of small detonation-dangerous objects, comprising an inner rotatable chamber arranged for manual rotation via a handle, FIG. 10 shows the blast-proof chamber according to FIG. 9, in which the inner chamber is rotated into the open position, FIG. 11 shows schematically a view obliquely from above of a fourth embodiment of a blast-proof chamber according to the invention, for handling of small detonation-dangerous objects, comprising an inner rotatable chamber, FIG. 12 shows schematically a detailed view of a blast-proof chamber according to FIG. 11, in which the inner rotatable chamber is in the closed vertical position, FIG. 13 shows schematically a detailed view of a blast-proof chamber according to FIG. 11, in which the inner rotatable chamber is in the open filling position, FIG. 14 shows schematically a detailed view of a blast-proof chamber according to FIG. 11, in which the inner rotatable chamber is in the open emptying position.

DETAILED DESCRIPTION OF EMBODIMENTS

FIGS. 1-4 show a first embodiment of a blast-proof chamber 1 according to the invention, especially intended for large detonation-dangerous objects, for example for handling and transport of vehicles prepared with explosive devices, or for transport of explodable goods of the ammunition or explosives type.

The blast-proof chamber 1 in FIGS. 1 and 2 comprises an outer chamber 2, in which an inner movably arranged chamber 3 for storage of the detonation-dangerous object is disposed. The outer chamber 2 is preferably configured as a container with square or rectangular cross section, comprising two longitudinal side parts 4, a roof part 5, a base part 6 and two end face parts 7, whereof the two longitudinal side parts 4 are open for loading and unloading of the detonation-dangerous object to and from the inner storage chamber 3.

The roof part 5 and base part 6 of the outer chamber 2 are constituted by parallelly arranged steel beams, the ends of which are fastened to the two end face parts 7. The steel beams are wholly or partially covered with steel plate.

The blast-proof chamber 1 is suited for loading and transportation as a conventional container on a lorry and comprises openings 8, on the side of the steel beams on the roof part and base part of the outer chamber 2, for a forklift truck. The chamber 1 also comprises fastening devices for a lifting crane. In a special embodiment, the chamber 1 is also equipped with wheels and hitches in order to act as a trailer.

The inner chamber 3 is preferably cylindrical with circular cross section, comprising a casing part 9, made of steel plate, and two open end face parts 10. A configuration other than a cylinder shape is also possible. The inner chamber 3 is rotatable in the horizontal direction in the outer chamber 2 about a vertical centre of rotation A-A. The chamber is opened by a quarter-turn rotation of the inner chamber 3 from the retracted closed position into the open extended position with the aid of a rotation mechanism 11 disposed between the roof part 5 of the outer chamber 2 and the casing part 9 of the inner chamber 3. The rotation mechanism 11 is preferably constituted. by a commercial-type gear mechanism and is therefore not more closely described in the continued text. The rotation mechanism 11 is remote-controlled, but can also be manual. The chamber 1 also comprises a locking and release mechanism 16 for locking and release of the inner chamber 3. The inner chamber 3 rests on a rotatably arranged support plate 15, preferably ball-bearing-mounted, which enables the inner chamber 3 to be rotated into different angles.

In a special variant, the support plate 15 is also rotatable in the vertical direction for angling of the inner chamber 3 in connection with loading and emptying of larger objects.

The locking and release mechanism 16 is preferably constituted by a spring bolt with pretensioning mechanism, in which the spring bolt is disposed between the outer and the inner chamber 2, 3. The spring bolt locks and releases the inner chamber 3 in the pretensioned and non-pretensioned state. The inner chamber 3, FIGS. 1 and 2, also comprises two lifting beams 12 mounted on the bottom side of the inner chamber 3, wherein the beams 12 are intended for unloading of the inner chamber 3 with the aid of a forklift truck.

The outer chamber 2 comprises two movably arranged closing end faces 13 for closing and opening of the inner chamber 3. The two closing end faces 13 are movable in the axial direction towards the two open end face parts 10 of the inner chamber 3. The closing end faces 13 are each mounted on four remote-controlled pistons 14 on the inner side of the end face parts 7 of the outer chamber 2. In a special embodiment, the closing end faces 13 also comprise an expandable sealing strip 29, for gas sealing of the joints between the inner storage chamber 3 and the closing end faces 13. In order to reduce the clearance between the closing end faces 13 and the end faces 10 of the inner chamber 3, the end faces 10 of the inner chamber 3 are convexly shaped and the two closing end faces 13 are concavely shaped, FIG. 1. FIG. 2 shows the chamber 1 in the open position.

In FIGS. 3 and 4 is shown a special variant 20 of the chamber 1 in FIG. 1. The special chamber 20 in FIG. 3, which comprises an outer chamber 21, an inner chamber 22 and two closing end faces 23, has no rotation mechanism for rotation of the inner chamber 22 in the horizontal direction. The inner chamber 22 can instead be pulled out in the lateral direction from a closed inner position into an open outer position. The special chamber 20 comprises two lifting beams 24, for forklift trucks mounted on the bottom side of the inner chamber 22, wherein the lifting beams 24 are configured to slide on the inner floor of the outer chamber 21 between two guide rails 25. FIG. 3 shows the chamber 20 in the retracted closed position, and FIG. 4 in the extended open position.

In FIGS. 5-8 is shown a second embodiment of a mobile blast-proof chamber 30 according to the invention. The chamber 30 according to FIG. 5 is intended for handling of smaller or medium-sized objects in a baggage control at an airport. If a baggage item is suspected of containing a detonation-dangerous object, the chamber 30 is closed once the baggage item is inside the chamber 30. The closed blast-proof chamber is thereafter transferred to a safe place. If no detonation-dangerous object is detected, the baggage item is transported onward through the chamber 30 via an internal conveyor belt 52 to a connecting conveyor belt 31 on the other side of the chamber 30.

The chamber 30, FIG. 6, comprises an outer chamber 32, in which an inner chamber 33 for storage of the detonation-dangerous object is disposed. The outer chamber 32 is preferably box-shaped with square or rectangular cross section, comprising two similar side parts 34, a top part 35, a bottom part 36, a back part and a front part 38 facing the baggage control, wherein the back part 37 and front part 38 of the chamber 30 are open for passage of a baggage item to and from the inner chamber 33. The outer chamber 32 comprises two fixedly mounted closing end faces 39 for closing and sealing of the inner chamber 33.

The top part 35 and bottom part 36 of the outer chamber 32 are constituted by parallelly arranged steel beams 40, preferably I-beams, the ends of which are fastened to the side parts 34 of the chamber 30. The steel beams are preferably wholly or partially covered with steel plate. The chamber 30 is also equipped with wheels for transport of the chamber 30.

The inner storage chamber 33 is preferably box-shaped with square or rectangular cross section and comprises two sides 41, an upper part 42, a lower part 43 and two open end face parts 44 for the in-feed and out-feed of baggage. The inner chamber 33 is rotatably arranged in the vertical plane of the outer chamber 32 between an open horizontal position and a closed vertical position. The inner chamber 33 can also have a configuration other than a box shape, for example a cylinder shape. The outer chamber 32, like the inner storage chamber 33, is preferably made of strong steel plate of the Weldox 900 type. The two open end face parts 44 of the inner chamber 33 are closable, when the inner chamber 33 is in the open horizontal position, via a chain-driven steel blind 46.

The inner storage chamber 33 is rotatable by remote control in the vertical plane of the outer chamber 32 via two horizontally arranged rotation shafts 45. The rotation shafts 45 are disposed between the inner chamber 33 and the outer chamber 32. The rotation shafts 45 are driven with an electric motor 46 via a chain 47 disposed between a larger drive wheel 4a on one of the rotation shafts 45 and a smaller gearwheel on the drive shaft of the motor 46. The inner chamber 33 is looked and sealed in the closed vertical position with the two closing end faces 39 and a locking and sealing mechanism comprising an expandable sealing strip 29.

The sealing strip 29 is preferably constituted by an inflatable rubber or plastics hose, connected to a pressure tank 49 via a gas line 50. The gas of the pressure tank 49 is preferably air or nitrogen gas, and pressurization of the locking and sealing strip 29 takes place preferably automatically in response to the rotation of the inner chamber 33 into the vertical closing position.

On the end face parts 44 of the inner chamber 33 and on the closing end faces 39 is arranged a groove for the application of a sealing strip 29. The sealing strip 29 can also be constituted by some other expandable material than a rubber hose, for example an expandable metal or metal alloy, which expands via electric voltage or heating. In order to reduce the clearance between the closing faces 39 and the inner chamber 33 during closing and opening, the end faces 44 of the inner chamber 33 are convexly shaped and the two closing end faces 39 are concavely shaped, FIG. 6.

If the baggage has been deemed to be at risk of detonation, the inner storage chamber 33 is closed in the horizontal position by the steel blind 46 of the inner chamber 33 being lowered over the two open end face parts 44. The storage chamber 33 is thereafter rotated into its vertical position, in which the locking mechanism of the closing end faces 39 is activated. The function of the steel blind 46 is to close the inner storage chamber 33 for incoming and outgoing baggage and keep the baggage in place in the storage chamber 33 during the rotation of the storage chamber 33.

On the inner side of the two sides 41 of the storage chamber 33 are arranged two vertical supporting walls 51, on which are mounted the drive rollers 53 of the internal conveyor belt 52.

The drive rollers 53 are normally driven by a separate, remote-controlled drive mechanism 54, but can also be coordinated with the outer conveyor belts 32 by coupling. The steel blind 46 of the storage chamber 33 runs on the end faces of the two supporting walls 51 via a chain 55 and is driven by two rotation shafts 56 disposed on the sides 41 of the inner chamber 33. The rotation shafts 56 are in turn driven by an electric motor 57 via a transverse gear-driven drive shaft 58 mounted on the upper part 42 of the inner chamber 33. The transverse drive shaft 58 drives the two rotation shafts 56 via two chains 59, one on either side 42 of the inner chamber 34.

In a first special embodiment of the chamber 30 in FIG. 6, the chamber 30 is arranged for emptying of the detonation-dangerous object into a collection bin directly beside the conveyor belt 31 without the chamber 30 needing to be moved. The detonation-dangerous object is emptied into the collection bin by tilting of the inner chamber 33, by about 45 degrees, towards the collection bin, which is placed obliquely below the inlet or outlet of the chamber 30. The steel blind 46 is rolled up and the internal conveyor belt 52 is started, whereupon the detonation-dangerous object is transferred to the collection bin. In a second special embodiment of the blast-proof chamber 30, the inner storage chamber 33 is arranged detachably from the outer chamber 32. The chamber 30 is emptied by the inner storage chamber 33 being released and lifted out from the outer chamber 32 for transport to another place. The release of the inner chamber 33 is realized by the rotation shafts 45 which hold the inner chamber in place being adjustable in the radial direction between an inner and an outer position, in which the outer position releases the storage chamber 33 and the inner position locks the storage chamber 33.

In FIGS. 9 and 10 is shown a third embodiment of a mobile blast-proof chamber 60 according to the invention, intended for handling of smaller detonation-dangerous objects in security controls at an airport. The chamber 60, comprising an outer chamber 61 and an inner chamber 62, is arranged for manual rotation of the inner storage chamber 62, in the horizontal plane of the outer chamber 61, between a closed and an open position. The inner chamber 62 is closed with two fixedly mounted closing end faces 63 disposed inside the outer chamber 61. The inner chamber 62 is rotated with the aid of a handle 64 mounted on the top side of the outer chamber 61, coupled to a rotation mechanism inside the chamber 60. FIG. 10 shows the inner storage chamber 61 in the open position. The chamber 60 is also equipped with a fixedly mounted wheel pair 66 on one side of the chamber 63 and a rotatable wheel 67 on the other side for guidance of the chamber 64 during transfer. In a special embodiment of the chamber 60, the inner chamber 62 is also arranged detachably from the outer chamber 61.

In FIGS. 11-14 is shown a fourth embodiment of a blast-proof chamber 70 according to the invention. The chamber 70 according to FIG. 11 is here meant to be used as a waste chamber (litter bin) for, for example, paper and plastics waste, and is intended for placement at airport terminals, bus and train stations or in underground railways, where there is increased risk. The blast-proof chamber 70 thus acts as an ordinary litter bin, but is also capable of handling the blast pressure from smaller explosive devices. The waste chamber 70 comprises an outer chamber 71, which comprises a rotatably arranged inner storage chamber 72.

The waste chamber 70 comprises two waste chutes, a waste chute for plastic 73 on one side of the waste chamber 70 and a waste chute for paper 74 on the other, opposite side of the waste chamber 70. The inner storage chamber 72 is rotatable in the vertical direction in the outer chamber 71 about a horizontal centre of rotation B-B via two similar rotation mechanisms 75, a rotation mechanism for the waste chute for plastic 73 and a rotation mechanism for the waste chute for paper 74. The inner chamber 72 is adjustable between three different positions in relation to the respective waste chute; a closed vertical position, a filling position, in which the chamber 72 is tilted by about 45 degrees, and an emptying position, in which the chamber 72 is angled by about 90 degrees into the horizontal position. The waste chutes 73, 74 are tubular and inclined, by about 45 degrees, for direct connection to the inner inclined chamber 72. Each of the tubular waste chutes 73, 74 comprises two protective flaps, an upper protective flap 76 and a lower protective flap 77. The upper protective flap 76 comprises a sensor 78, which senses when the upper protective flap 76 is opened for the filling of waste.

When the upper protective flap 76 is opened, the sensor 78 activates the rotation mechanism of the waste chamber 70 for plastic 75 or for paper via a control and monitoring unit 79, whereupon the inner chamber 72 is tilted and connects to one of the tubular waste chutes for plastic 73 or for paper 74. After a certain time delay, the lower protective flap 77 is opened, at the same time as the upper protective flap 76 is closed. After a further time delay, the lower protective flap 77 is closed, at the same time as the inner chamber 72 is rotated back into its vertical closing position.

The rotation mechanism 75 is driven by an electric motor 80 via a chain 81 and two gearwheels 82, 83, a smaller gearwheel 82 connected to the drive shaft of the motor, and a larger gearwheel 83 connected to a rotation shaft 84 on the inner chamber 72. The inner chamber 72 is closed with two fixedly mounted closing end faces, an upper closing end face 85 and a lower closing end face 86. On the closing end faces 85, 86 are disposed two axially movable sleeves 87, 88, an upper 87 and a lower sleeve 88, which sleeves, when activated, slide over the closing end faces 85, 86 and over the end faces of the inner chamber 72 and thus lock the chamber 70. The sleeves 87, 88 are preferably driven by a separate piston mechanism (not shown), but can also be connected to the rotation mechanism of the inner chamber 72. In the sleeves 87, 88, a sealing strip can also be incorporated for gas sealing. The inner chamber 72 is divided into two sections, a plastic section 89 for plastics waste and a paper section 90 for paper waste. The two sections are separated from each other with a wall 91.

The invention is not limited to the shown embodiments, but can be varied in different ways within the scope of the patent claims.

The invention claimed is:

1. Blast-proof chamber for handling and transport of a detonation-dangerous object, comprising an outer chamber in which an inner storage chamber is arranged for storage of the detonation-dangerous object, wherein the inner storage chamber is arranged movably in the outer chamber between an open and a closed position, wherein the blast-proof chamber comprises two separate closing end faces disposed in the outer chamber for closing and sealing of the inner chamber, and wherein the inner storage chamber is arranged rotatably in the outer chamber between an open and a closed position, via a rotation mechanism disposed in the outer chamber.

2. Blast-proof chamber or handling and transport of a detonation-dangerous object according to claim 1, wherein the inner storage chamberis arranged detachably in the outer chamber.

3. Blast-proof chamber for handling and transport of a detonation-dangerous object according to claim 2, wherein the outer chamber is box-shaped or container-shaped with square or rectangular cross section comprising two long sides, a base, a roof and two end faces, whereof the two long sides are open for loading and unloading of the detonation-dangerous object to and from the inner chamber, and in that the inner chamber is tubular with circular cross section comprising a casing part and two end face parts, wherein the two end face parts are open for loading and unloading of the detonation-dangerous object.

4. Blast-proof chamber for handling and transport of a detonation-dangerous object according to claim 3, which comprise a rotation mechanism, wherein the rotation mechanism is manual and is operated with a detachable handle disposed on the top side of the outer chamber, wherein the handle is rotatable by a quarter turn, clockwise or anti-clockwise, in a horizontal plane between an open and a locked position, in which the open position automatically releases the inner chamber from the outer chamber via a pretensioned locking mechanism.

5. Blast-proof chamber for handling and transport of a detonation-dangerous object according to claim 4, which comprises a spring bolt, wherein the spring bolt is pretensioned via an electromagnetically controlled spring mechanism.

6. Blast-proof chamber for handling and transport of a detonation-dangerous object according to claim 3, which comprise a release mechanism, wherein the release mechanism comprises a spring bolt and a pretensioning mechanism, wherein the spring bolt in the pretensioned state locks the inner chamber and in the non-pretensioned state releases the inner chamber.

7. Blast-proof chamber for handling and transport of a detonation-dangerous object according to claim 3, wherein the outer chamber also comprises a rotatable support plate on which the inner chamber rests.

8. Blast-proof chamber for handling and transport of a detonation-dangerous object according to claim 1, wherein the outer chamber is box-shaped or container-shaped with square or rectangular cross section comprising two long sides , a base, a roof and two end faces, whereof the two long sides are open for loading and unloading of the detonation-dangerous object to and from the inner chamber, and in that the inner chamber is tubular with circular cross section comprising a casing part and two end face parts, wherein the two end face parts are open for loading and unloading of the detonation-dangerous object.

9. Blast-proof chamber for handling and transport of a detonation-dangerous object according to claim 8, wherein the outer chamber also comprises a rotatable support plate on which the inner chamber rests.

10. Blast-proof chamber for handling and transport of a detonation-dangerous object according to claim 1, wherein the inner storage chamber is rotatable in a vertical plane of the outer chamber.

11. Blast-proof chamber for handling and transport of a detonation-dangerous object according to claim 1, wherein the closing end faces are arranged movably in the axial direction in the outer chamber via hydraulic pistons disposed on the inner side of the outer chamber.

12. Blast-proof chamber for handling and transport of a detonation-dangerous object according to claim 1, wherein the two closing end faces comprise an expandable sealing strip for locking and sealing of the inner chamber.

13. Blast-proof chamber for handling and transport of a detonation-dangerous object according to claim 1, wherein the blast-proof chamber comprises a rotation mechanism, wherein the rotation mechanism is manual and is operated with a detachable handle disposed on the top side of the outer chamber, wherein the handle is rotatable by a quarter turn, clockwise or anticlockwise, in the horizontal plane between an open and a locked position, in which the open position automatically releases the inner chamber from the outer chamber via a pretensioned locking mechanism.

14. Blast-proof chamber for handling and transport of a detonation-dangerous object according to claim 13, wherein the spring bolt is pretensioned via an electromagnetically controlled spring mechanism.

15. Blast-proof chamber for handling and transport of a detonation-dangerous object according to claim 1, wherein the blast-proof chamber comprises a release mechanism, wherein the release mechanism comprises a spring bolt and a pretensioning mechanism, wherein the spring bolt in the pretensioned state locks the inner chamber and in the non-pretensioned state releases the inner chamber.

* * * * *